US008382546B2

(12) United States Patent
Van Ruymbeke

(10) Patent No.: US 8,382,546 B2
(45) Date of Patent: Feb. 26, 2013

(54) FLYING TOY ABLE TO MOVE BY THE FLAPPING OF WINGS

(76) Inventor: Edwin Van Ruymbeke, Marseilles (FR)

( * ) Notice: Subject to any disclaimer, the term of this patent is extended or adjusted under 35 U.S.C. 154(b) by 2 days.

(21) Appl. No.: 12/830,402

(22) Filed: Jul. 5, 2010

(65) Prior Publication Data

US 2012/0003896 A1 Jan. 5, 2012

(51) Int. Cl.
*A63H 27/28* (2006.01)

(52) U.S. Cl. ..... 446/35; 244/11; 244/22; 244/72

(58) Field of Classification Search ..... 244/11, 244/22, 72, 87, 99, 28, 16, 190, 38, 215, 244/153 R, 154, 155 A; 446/34, 376, 484, 446/330, 490, 35, 352, 457, 459
See application file for complete search history.

(56) References Cited

U.S. PATENT DOCUMENTS

| | | | | |
|---|---|---|---|---|
| 2,810,985 | A * | 10/1957 | Bilder | 446/56 |
| 3,310,261 | A * | 3/1967 | Rogallo et al. | 244/219 |
| 3,584,813 | A * | 6/1971 | Sweeney et al. | 244/219 |
| 3,942,747 | A * | 3/1976 | Wolkovitch | 244/13 |
| 4,195,438 | A * | 4/1980 | Dale et al. | 446/35 |
| 4,729,748 | A * | 3/1988 | Van Ruymbeke | 446/35 |
| 4,919,637 | A * | 4/1990 | Fleischmann | 446/162 |
| 5,163,861 | A * | 11/1992 | Van Ruymbeke | 446/35 |
| 5,899,408 | A * | 5/1999 | Bowers, Jr. | 244/11 |
| 6,544,092 | B1 * | 4/2003 | Tomas | 446/35 |
| 6,550,716 | B1 * | 4/2003 | Kim et al. | 244/11 |
| 6,632,119 | B2 * | 10/2003 | Chernek et al. | 446/35 |
| 6,769,949 | B2 * | 8/2004 | Kim et al. | 446/35 |
| 2002/0173217 | A1 * | 11/2002 | Kinkade | 446/35 |

FOREIGN PATENT DOCUMENTS

| | | | |
|---|---|---|---|
| EP | 1 958 681 | A1 | 8/2008 |
| FR | 2934789 | A1 | 2/2010 |
| WO | WO 2010015781 | A1 | 2/2010 |

* cited by examiner

*Primary Examiner* — Gene Kim
*Assistant Examiner* — John E Simms, Jr.
(74) *Attorney, Agent, or Firm* — Jackson Patent Law Office

(57) ABSTRACT

Disclosed is a flying toy capable of moving by flapping of wings. The flying toy comprises a support structure; an actuation mechanism, for the wings, arranged on the support structure and comprising a crank drive rotated by a means providing the driving force; and two flexible wings arranged symmetrically with respect to the vertical plane of symmetry of the toy and connected, at the wing bases, to the actuation mechanism, the aforementioned wing bases being mounted oscillating about axes arranged on both sides of the vertical plane of symmetry of the toy. A controller receives a control signal indicating a left turn, increases the tension on the right wing and reduces it on the left wing and, for a right turn, the opposite action is performed.

13 Claims, 5 Drawing Sheets

FLYING TOY ABLE TO MOVE BY THE FLAPPING OF WINGS

TECHNICAL FIELD OF THE INVENTION

An object of the invention is an improvement to a flying toy moving in the air by flapping of wings.

It relates to the general technical field of flying toys, and more particularly those imitating the flight of a bird which they may resemble.

PRIOR ART

The patent documents FR 1,604,345 (G. VAN RUYMBEKE) and EP 0,449,922 (G. VAN RUYMBEKE) describe a flying toy of this type comprising:

- a hollow body having an elongated shape and in the front which is housed an actuation mechanism driven by an elastic strap providing driving force;
- two flexible wings attached, first, to the actuation on the one hand, the activation mechanism and second, on the body;
- a winding system for twisting of the elastic strap motor.

In this type of flying toy, the actuation mechanism for the wings generally comprises two oscillating levers—or wing bases—connected or designed to be connected, each to a wing spanwise beam on which is attached the front edge of a flexible airfoil constituting the wings of the aforementioned toy. In principle, the beating of wings suffices to ensure the levitation of the flying toy.

Several techniques enable turning of these flying toys. The patent documents GB 442,667 (HAENLE), GB 20145.AAD.1910 (EUSTACE), U.S. 2004/155145 (YOSHIJI) or U.S. Pat. No. 1,450,480 (JAMES), teach for example changing the angle of incidence of the wings so that the toy turns right or left.

Known more particularly, from the patent document EP 1,958,681 (PROXYFLYER), is a flying toy that can turn in a desired direction, using a different drag on the wings. A control means, which receives a control signal indicating a left turn, increases the angle of incidence on the left wing and reduces it on the right wing. For a right turn, the opposite action is performed.

The wings of this toy have airfoil surfaces that have an increased drag when the angle of incidence increases. In practice, this technique does not enable turning of the toy with great precision.

Moreover, when the speed of the toy is too high, the controls can be inverted: the increase of the angle of incidence on the right wing (respectively left) drives a steering to the left (respectively right). The control of such a toy can be random.

Given this state of affairs, the principal objective of the invention is to work out a technique enabling more precise and more effective turning of a flying toy of the type known from the prior art.

DISCLOSURE OF THE INVENTION

The solution offered by the invention is a flying toy capable of moving by flapping of wings and comprising:

- a support structure,
- an actuation mechanism for the wings arranged on the support structure and comprising a crank drive rotated by a means providing the driving force,
- two flexible wings arranged symmetrically with respect to the vertical plane of symmetry of the toy and connected, at the wing bases, to the actuation mechanism, the aforementioned wing bases being mounted oscillating about axes arranged on both sides of the vertical plane of symmetry of the toy, This toy is nonetheless remarkable in that a control means, that receives a control signal indicating a left turn, increases the tension on the right wing and reduces it on the left wing, for a right turn, the opposite action being performed. Unlike the known techniques of the prior art and in particular those described in EP 1,958,681 (PROXYFLYER), a turn to the right or to the left is controlled by the tension of the opposite wing and not by changing the angle of incidence.

According to a preferred implementation mode, the posterior edges of the main airfoil of the wings are attached on a rudder configured to pull laterally on the aforementioned edges, in the plane of the wings, so as to change the tension of the aforementioned wings:

- a lateral traction on the posterior edge of the right wing increases the tension on the right wing and decreases the tension on the left wing,
- a lateral traction on the posterior edge of the left wing increases the tension on the aforementioned left wing and decreases the tension on the right wing.

Advantageously, the rudder is mounted pivoting around an axis perpendicular to the plane of the wings, the pivoting of the aforementioned rudder causing a lateral traction on the posterior edges of the main airfoil of the aforementioned wings.

In an implementation variation, the rudder is mounted mobile in translation in a direction parallel to the plane of the wings, the displacement of the rudder causing a lateral traction on the posterior edges of the main airfoil of the aforementioned wings.

The movement of the rudder preferably is controlled via a radio-controlled motor.

To enable the flying toy to follow a straight path in the absence of stress on the wings, a return spring enables automatic restoration of the rudder into a neutral position where no tension is exerted on the posterior edges of the main airfoil of the wings.

According to another advantageous feature of the invention:

- the radio-controlled motor is provided with a reduction ratio device,
- and wherein the spring is pretensioned in the neutral position, the legs of the aforementioned spring being held apart by an element, the aforementioned pre-tension enabling restoration of the rudder positively into the neutral position, compensating for the residual frictions of the reduction ratio device.

Preferably, the wings comprise spanwise wing beams connected to the wing bases, the aforementioned spanwise beams being formed from a first part inserted into the aforementioned wing bases and at the end of which is attached a rod, the latter being pivotally mounted, about its longitudinal axis, in the aforementioned first part.

The rods can be tightly fitted and/or cemented in a sheath, the latter covering the aforementioned rods so as to consolidate their base and decrease the fragility at this area.

DESCRIPTION OF THE FIGURES

Other advantages and features of the invention will become more apparent upon reading the description of a preferred implementation mode which follows, with reference to the accompanying drawings, made by way of indicative and non limiting examples and wherein.

IMPLEMENTATION MODES OF THE INVENTION

The flying toy object of the invention is typically a toy imitating the flight of a bird, whose appearance it has. It may be however any other type of flying toy that moves by flapping of wings, for example having the appearance of an insect or an imaginary winged character.

Figure 1:
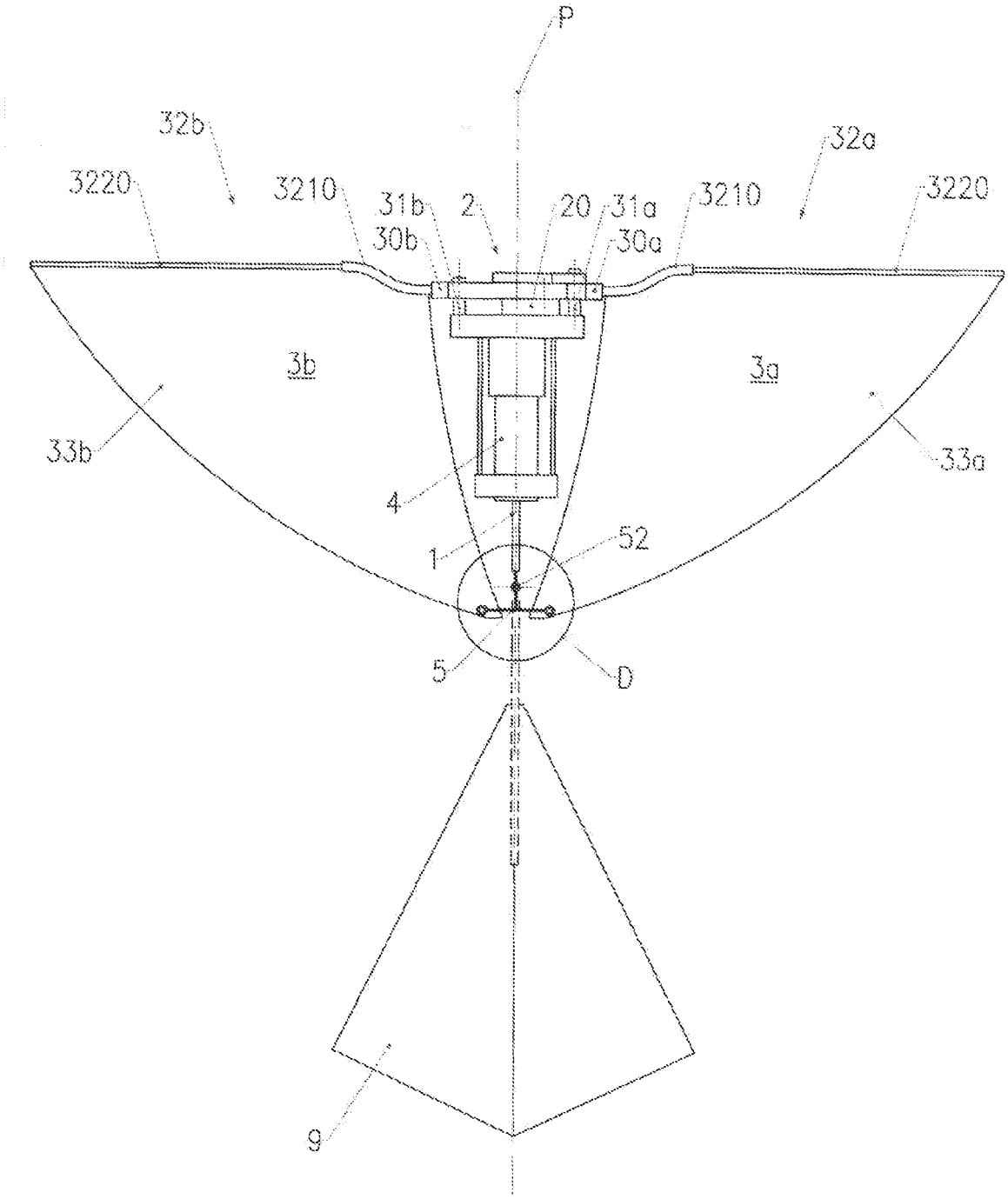
FIG. 1 is a schematic top view showing the layout of various components of a toy in accordance with the invention.

Referring to FIG. 1, the toy object of the invention comprises a support structure 1 on which are arranged the various components of the mechanism 2 of driving wings and steering rudder 5. A hollow body (not shown) having elongated shape, evoking the body of a bird, and typically made of plastic, will cover the support structure 1 in order to conceal the various components of the drive mechanism of the wings and rudder.

According to FIG. 1, the actuation mechanism 2 of wings 3*a*, 3*b* is arranged on the support structure 1 in the front part of the latter. This actuation mechanism 2 enables communication of identical oscillations to the wings 3*a*, 3*b* and more particularly the bases of wing 30*a*, 30*b*. This actuation mechanism 2 comprises a drive crank 20 rotated by means 4 providing the driving force. The means 4 providing the driving force to the crank 20 can be elastic. In this case, a winding device enabling twisting of the elastic will be provided. This type of elastic system providing power to the crank 20 is for example described in FIG. 5 of the document EP 0,449,922. However, the means 4 providing the driving force is preferably an electric motor 40 coupled to a reduction gear 41. The electric motor 40 is of the type known to the person of skill in the art, powered by battery or by cell and whose operation can be controlled by a remote control of the radio-control type. By actuating this dedicated control, the user will transmit a control signal causing the flapping of the wings to drive the flight of the toy or to the contrary stopping the beating during the landing and/or to simulate periods of gliding. The actuation mechanism 2 of wings 3*a*, 3*b*, however, is well known to the person of skill in the art and will therefore not be described here in more detail.

The two flexible wings 3*a*, 3*b* are arranged symmetrically with respect to the vertical plane of symmetry P of the toy and connected at the wing bases 30*a*, 30*b*, to the actuation mechanism 2. The bases of the wings are mounted oscillating in the two directions about axes 31*a*, 31*b* arranged symmetrically with respect to the plane P. In practice, the external part of the bases 30*a*, 30*b* is connected, or arranged to be couplable, for example by interlocking, to the spanwise wing beams 32*a*, 32*b* on which is coupled the front edge of the main airfoil 33*a*, 33*b*.

The spanwise wing beams 32*a*, 32*b* have a diameter of approximately 0.6 mm and are typically made of plastic or carbon. However, to further lighten the structure of the toy while retaining good rigidity, the spanwise wing beams 32*a*, 32*b* are made wholly or partially of liquid crystal polymer (LCP or for "Liquid Crystal Polymer" in English) combined with carbon fibers.

Figure 5A:
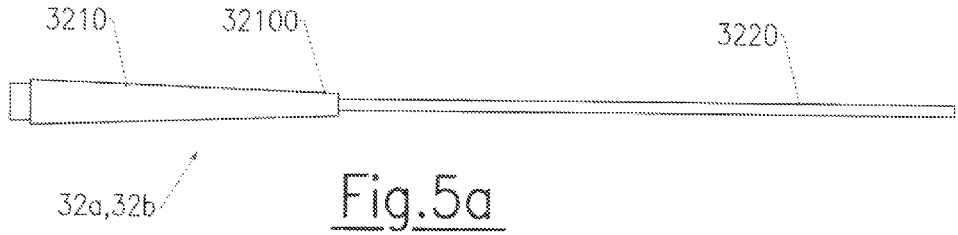
FIGS. 5*a* and 5*b* show respectively a front view and a top view of a second implementation mode for the spanwise wing beam.
Figure 5B:
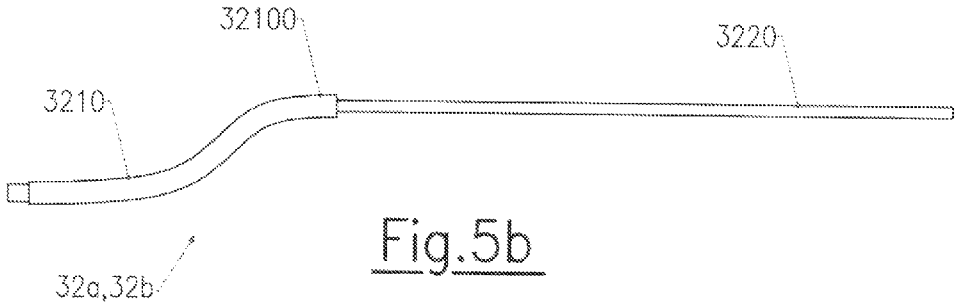

In the implementation modes shown in FIGS. 5*a* and 5*b*, the spanwise wing beams 32*a*, 32*b* are formed from a first part 3210 inserted into the wing bases 30*a*, 30*b*. This first part can have a tapered section at the end of which is attached a rod 3220 (FIG. 5*a*). In a second implementation mode (FIGS. 1 and 5*b*), the first part of 3210 has a "gooseneck" curvature type oriented toward the front of the toy enabling an esthetic closer to a bird, without losing efficiency. This configuration also enables displacement of the center position of the airfoil towards the front of the toy, which enables modification of the flight attitude without displacing the center of gravity.

Advantageously, the rods 3200 are mounted pivoting, along their longitudinal axis, in the first parts 3210. The rods 3220 may also be mounted sliding in the first parts 3210.

Figure 6:
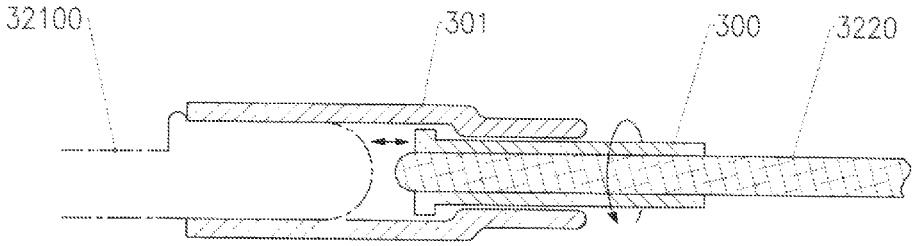
FIG. 6 is a longitudinal section view showing an example of attachment of a rod to the end of a part of a spanwise wing beam.

Referring to FIG. 6, the rods 3220 are tightly fitted and/or cemented in a sheath 300. The latter is made of a semi-rigid plastic. The sheath 300 covers the rods 3220 over a length of approximately 1 cm in order to consolidate their base and reduce the fragility in this area.

The sheath 300 is advantageously mounted mobile in rotation, and possibly sliding, in a sleeve 301 itself tightly fitted and/or cemented to the end 32100 of the first part 3210. During the flight of the toy, the rods 3220 can be subject to longitudinal axis torsional stresses. However, because the carbon rods have poor torsional rigidity, a non negligible risk of fracture exists. The degree of freedom of rotation of the sheath 300 cancels these torsional stresses and reduces the risks of fracture.

In practice, when they are manufactured and/or delivered, the rods 3220 are never perfectly straight but have a certain curvature. In these conditions, if the rods 3220 are rigidly connected to the first parts 3210, the curvatures of each wing 3*a*, 3*b* can not be symmetrical with respect to the plane P, which inevitably leads to an irregular, even random, flight. The degree of freedom of rotation of the sheath 300 enables natural restoration of the curvature of the rods 3220 toward the rear of toy, symmetrically with respect to the plane P.

The technique used in the invention and enabling rotation of the toys toward the right or toward the left will now be described in more detail with reference to FIGS. 1-4. In accordance with the invention, a control means 5, that receives a control signal indicating a left turn, increases the tension on the right wing 33*a* and reduces it on the left wing 33*b*. For a right turn, the control means 5 increases the tension on the left wing 33*b* and reduces it on the right wing 33*a*. A turn to the right or to the left is controlled by the tensioning of the opposite wing and not by changing the angle of incidence as is taught in the prior art.

Referring to FIG. 1, the posterior edges of the main airfoil 33*a*, 33*b* of the wings are attached to a rudder 5 configured to pull laterally on the aforementioned edges, in the plane of the aforementioned wings (plane of FIG. 1 or 2 and perpendicular to the plane P), so as to change the tension of the aforementioned wings:

- a lateral traction on the posterior edge of the right wing 33*a* increases tension on the aforementioned right wing and decreases the tension on the left wing 33*b*: the toy turns left,
- a lateral traction on the posterior edge of the left wing 33*b* increases the tension on the aforementioned left wing and decreases the tension on the right wing 33*a*: the toy turns right.

Figure 2:
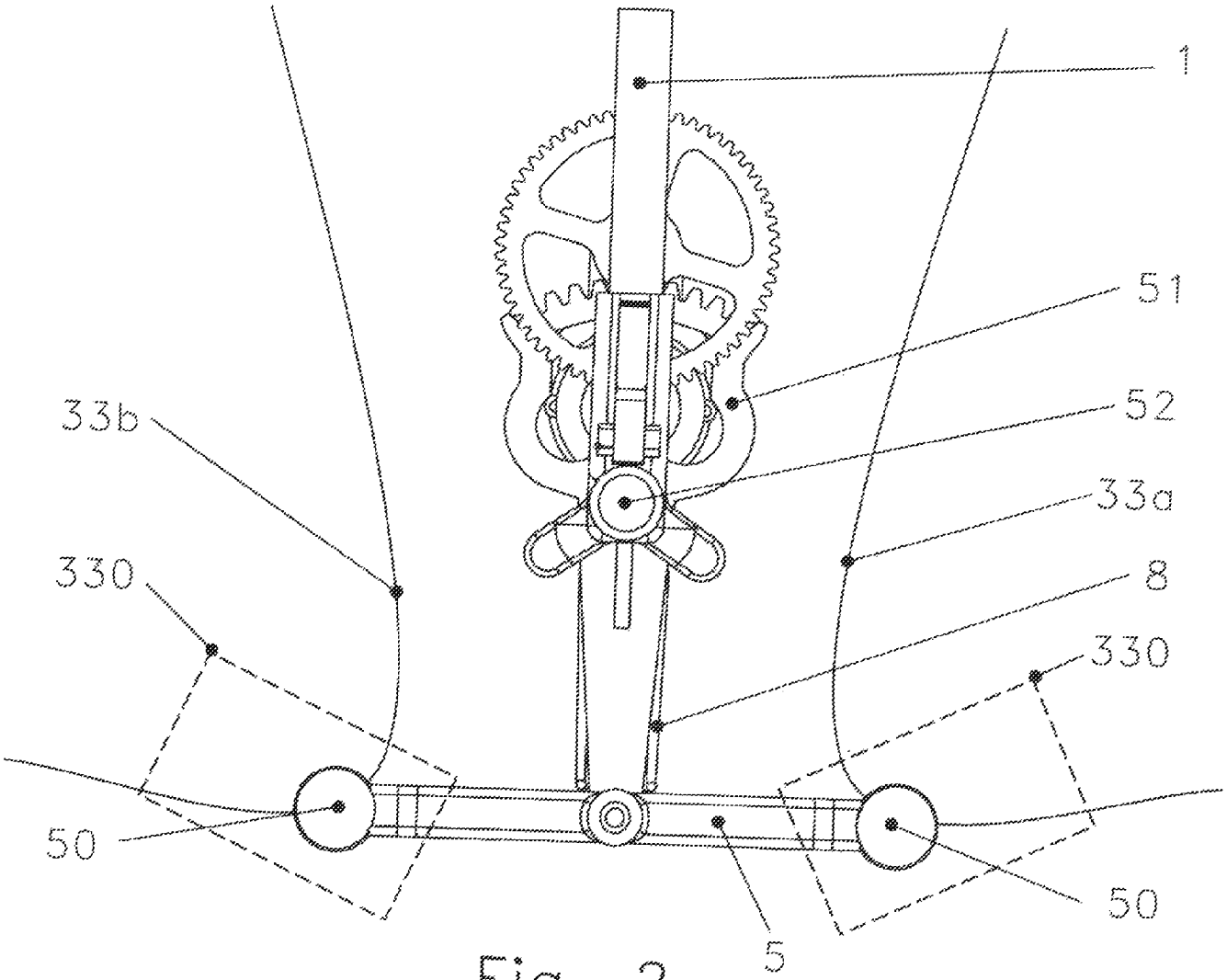
FIG. 2 is an enlarged view of detail D of FIG. 1, showing, from above, the tensioning device for the wings.
Figure 3:
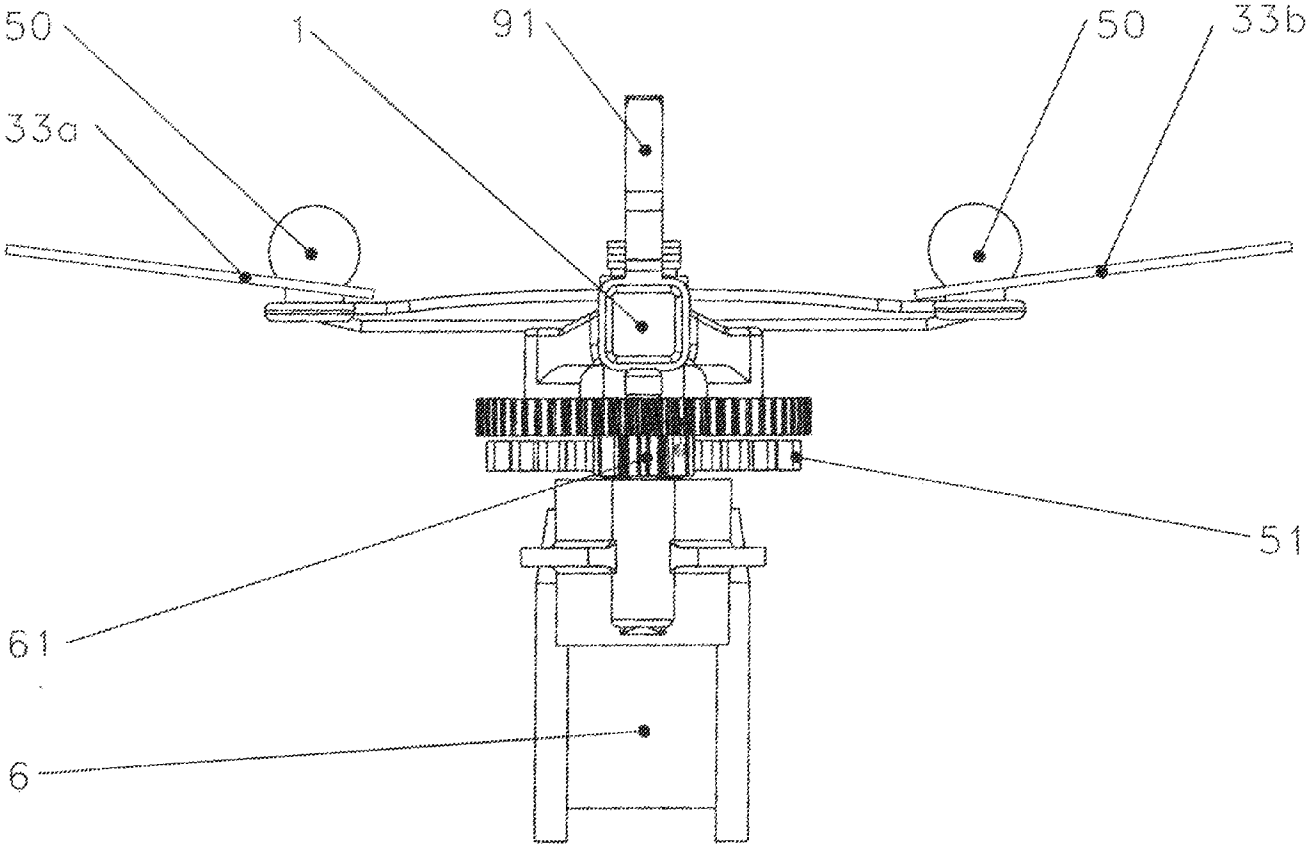
FIG. 3 is a front view of the tensioning device for the wings.
Figure 4:
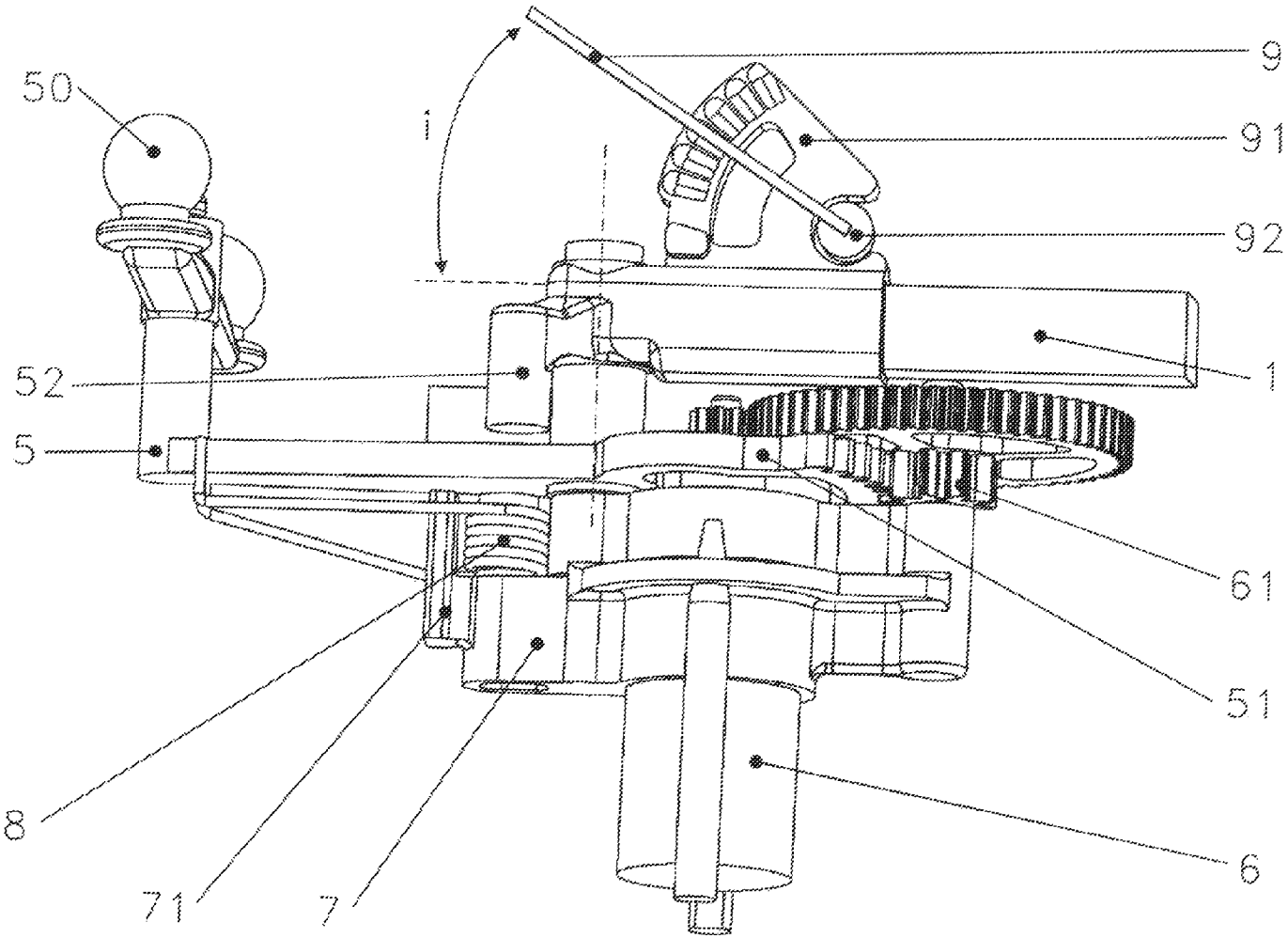
FIG. 4 is a perspective view of the tensioning device for the wings.

Referring to FIG. 2, the rudder 5 has the shape of a T of which the ends of the crossbar are attached to the posterior edges of the main airfoil 33*a*, 33*b* of the wings. The attachment can be made via a piece 330 more rigid than the airfoil and cemented on the aforementioned airfoil and that comprises a hole that fits on a ball-shaped pin 50 (FIG. 3). The T-like longitudinal bar is terminated by a gear 51 meshing with a pinion 61 driven by an electric motor 6 (FIG. 4). The latter is of the type known to the person of skill in the art, powered by battery or by cell and whose operation is controlled by a remote control of the radio-control type. The direction of rotation of the motor 6 depends on the control signal that is sent to it. A reduction ratio device can be between the pinion gear 61 and the rotation shaft of the motor 6. The latter is secured to a base 7 attached to the support structure 1. The rudder 5 is pivotally mounted around an axis 52 perpendicular to the plane of the wings 33*a*, 33*b*. In practice, the axis 52 is a vertically projecting element of the base 7, the T-like longitudinal bar forming the rudder 5 being mounted freely in rotation around this axis. In this configuration, when the motor 6 receives a control signal (to turn right or to left turn), the pinion 61 rotates, driving the gear 51. The rudder 5 then pivots either right or left by applying lateral tension on the posterior edges of the wings 33*a*, 33*b*. In reality, the ends 50 of the rudder 5 draw an arc whose center is the axis of rotation 52.

Referring to FIGS. 2 and 4, a return spring 8 enables automatic restoration of the rudder 5 in a neutral position where no tension is exerted on the posterior edges of the main airfoil 33*a*, 33*b* of the wings. In practice, a spiral spring 8 attached on the base 7 and from which the legs are arranged on both sides of the T-like longitudinal bar forming the rudder 5, is used. The spring 8 is pretensioned in the neutral position, the legs of the aforementioned spring 8 being held apart by an element 71 of the base 7. At rest, the rudder 5 is in a neutral position, i.e. extending from the support structure 1. When the rudder 5 leaves this position, the legs of the spring 8 tend to return it into the neutral position. The spring 8 having a pre-tension and resting on the element 71, the rudder 5 is positively returned to the neutral, compensating for the residual friction of the reduction ratio device. This enables the flying toy to follow a straight path when the motor 6 is stopped.

In an implementation variation not shown, the rudder 5 is mounted mobile in translation in a direction parallel to the plane of the wings 3*a*, 3*b*, the displacement of the aforementioned rudder causing a lateral tension on the posterior edges of the main airfoil 33*a*, 33*b* of the aforementioned wings. In practice, a rudder 5 comprising a longitudinal control rod with ends to which are attached the posterior edges of the main airfoil 33*a*, 33*b* of the wings 3*a*, 3*b*, can be used. This control rod is engaged on a toothed pinion driven by the electric motor 6. The rotation of the toothed pinion drives the translation to the right or to the left of rudder 5 and alters de facto the tension of the wings 3*a*, 3*b*. A return spring similar to that described above will enable automatic restoration of the rudder 5 in a neutral position where no tension is exerted on the posterior edges of the main airfoil 33*a*, 33*b* of the wings.

Referring to FIGS. 1 and 4, the posterior part of the toy is provided with a tail airfoil 9 arranged symmetrically with respect to the vertical plane of symmetry P of the aforementioned toy. This tail airfoil 9 can be orientable in a vertical plane so as to adjust the type of flight: when the tail is raised, a slow flight is obtained and when the tail is lowered, practically to the horizontal, a fast flight is obtained. The inclination of the tail 9 can be automatically controlled by means of a radio-controlled motor. However, the angle of inclination of the tail 9 can be manually adjusted. To do this, and referring to FIG. 4, the end of the tail 9 is pivotally mounted around a horizontal axis of rotation 90. A latching device 91 attached on the base 7 enables maintenance in position of the tail 9 corresponding to a desired angle of inclination "i".

The invention claimed is:

1. A flying toy capable of moving by flapping of wings, the flying toy comprising:

a support structure, an actuation mechanism arranged on the support structure and comprising a rotatable crank drive, two flexible wings each comprising a wing base, the two flexible wings being arranged symmetrically with respect to a vertical plane of symmetry of the toy and connected, at the wing bases, to the actuation mechanism, the wing bases being mounted oscillating about axes arranged on both sides of the vertical plane of symmetry of the toy, and a motor that, responsive to receiving a control signal indicating a left turn, increases a tension on the right wing while reducing a tension on the left wing thereby effecting a left turn, and that, responsive to receiving a control signal indicating a right turn, increases the tension on the left wing while reducing the tension on the right wing thereby effecting a right turn.

2. A toy according to claim 1, wherein posterior edges of a main airfoil of the wings are attached on a rudder configured to pull laterally on the edges, in a plane of the wings, so as to change the tension of the wings:

a lateral traction on the posterior edge of the right wing increases the tension on the right wing and decreases the tension on the left wing, a lateral traction on the posterior edge of the left wing increases the tension on the left wing and decreases the tension on the right wing.

3. A toy according to claim 2, wherein the rudder is mounted pivoting around an axis perpendicular to the plane of the wings, the pivoting of the rudder causing a lateral traction on the posterior edges of the main airfoil of the wings.

4. A toy according to claim 2, wherein the rudder is mounted movable in translation in a direction parallel to the plane of the wings, a displacement of the rudder causing a lateral traction on the posterior edges of the main airfoil of the wings.

5. A toy according to claim 2, wherein a movement of the rudder is controlled via a radio-controlled motor.

6. A toy according to claim 2, wherein a return spring enables restoration of the rudder in a neutral position where no traction is exerted on the wings.

7. A toy according to claim 6, wherein:

the movement of the rudder is controlled via a radio-controlled motor, the radio-controlled motor is provided with reduction ratio device, and wherein the spring is pretensioned in the neutral position, the arms of the spring being held apart by an element, the pre-tension enabling restoration of the rudder positively into the neutral position, compensating for the residual frictions of the reduction ratio device.

8. A toy according to claim 1, wherein the wings comprise spanwise wing beams connected to the wing bases, the spanwise beams being formed from a first part inserted into the wing bases and at the end of which is attached a rod, the latter being pivotally mounted, about its longitudinal axis, in the first part.

9. A toy according to claim 8, wherein the rods are tightly fitted and/or cemented in a sheath, the latter covering the rods so as to consolidate their base and decrease the fragility at this area.

10. A method for controlling a flying toy capable of moving by flapping of wings, the toy comprising:

a support structure, an actuation mechanism arranged on the support structure and comprising a rotatable crank drive, two flexible wings each comprising a wing base, the two flexible wings being arranged symmetrically with respect to a vertical plane of symmetry of the toy and connected, at the wing bases, to the actuation mechanism, the wing bases being mounted oscillating about axes arranged on both sides of the vertical plane of symmetry of the toy, the method comprising:

receiving a control signal, responsive to the control signal indicating a right turn, increasing the tension on the left wing while reducing a tension on the right wing, to effect a right turn, and responsive to the control signal indicating a left turn, increasing the tension on the right wing while reducing the tension on the let wing, to effect a left turn.

11. A toy according to claim 1, further comprising a wheel defining an axis of rotation substantially parallel to the vertical plane, wherein the motor increases the tension on the right wing while reducing the tension on the left wing by rotating the wheel in a first direction, and increases the tension on the left wing while reducing the tension on the left wing by rotating the wheel in a second direction opposite the first direction.

12. A toy according to claim 11 wherein the wheel is a gear.

13. A flying toy capable of moving by flapping of wings, the flying toy comprising:

a support structure, an actuation mechanism arranged on the support structure and comprising a rotatable crank drive, two flexible wings each comprising a wing base, the two flexible wings being arranged symmetrically with respect to a vertical plane of symmetry of the toy and connected, at the wing bases, to the actuation mechanism, the wing bases being mounted oscillating about axes arranged on both sides of the vertical plane of symmetry of the toy, means, responsive to a control signal indicating a right turn, for increasing the tension on the left wing while reducing a tension on the right wing, to effect a right turn, and means, responsive to the control signal indicating a left turn, for increasing the tension on the right wing while reducing the tension on the left wing, to effect a left turn.

* * * * *